US008827392B2

(12) United States Patent
Yoshida et al.

(10) Patent No.: US 8,827,392 B2
(45) Date of Patent: Sep. 9, 2014

(54) LIQUID EJECTING APPARATUS AND MAINTENANCE METHOD THEREOF

(71) Applicant: Seiko Epson Corporation, Tokyo (JP)

(72) Inventors: Atsushi Yoshida, Matsumoto (JP); Hiroyuki Ito, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 13/724,168

(22) Filed: Dec. 21, 2012

(65) Prior Publication Data

US 2013/0169708 A1 Jul. 4, 2013

(30) Foreign Application Priority Data

Dec. 28, 2011 (JP) ..... 2011-287711
Dec. 28, 2011 (JP) ..... 2011-287712

(51) Int. Cl.
*B41J 29/38* (2006.01)
*B41J 2/165* (2006.01)

(52) U.S. Cl.
CPC ..... *B41J 2/1652* (2013.01); *B41J 2/16532* (2013.01); *B41J 2002/16573* (2013.01)
USPC ..... 347/6; 347/17; 347/23

(58) Field of Classification Search
CPC .. B41J 2/04528; B41J 2/04515; B41J 2/0458; B41J 2/04588; B41J 2/1652; B41J 2/04531; B41J 2/0454; B41J 2/04563
See application file for complete search history.

(56) References Cited

U.S. PATENT DOCUMENTS 5,302,971 A * 4/1994 Ohba et al. ..... 347/6

FOREIGN PATENT DOCUMENTS

JP 2003-103207 4/2003
JP 2007-130907 5/2007

* cited by examiner

*Primary Examiner* — Juanita D Jackson
(74) *Attorney, Agent, or Firm* — Workman Nydegger

(57) ABSTRACT

A liquid ejecting apparatus includes heating portions for heating liquid, a liquid ejecting head for ejecting the liquid heated by the heating portions, and a maintenance device for performing maintenance of the liquid ejecting head by causing the liquid to be discharged from the liquid ejecting head through sucking operation. The maintenance device performs a first suction for cleaning the liquid ejecting head by causing the head to discharge the liquid, waits until liquid is heated by the heating portions, and then performs a second suction with a suction force weaker than that of the first suction.

19 Claims, 6 Drawing Sheets

LIQUID EJECTING APPARATUS AND MAINTENANCE METHOD THEREOF

CROSS REFERENCES TO RELATED APPLICATIONS

The entire disclosure of Japanese Patent Application Nos. 2011-287711, filed Dec. 28, 2011, 2011-287712, filed Dec. 28, 2011 are expressly incorporated by reference herein.

BACKGROUND

1. Technical Field

The present invention relates to a liquid ejecting apparatus and a maintenance method thereof.

2. Related Art

Ink jet printers are known as a recording apparatus that records images, characters, and the like by ejecting liquid to a recording media. In the case of using a relatively high viscous ink (liquid) for such an ink jet printer, the control of ink viscosity becomes important to realize favorable ink ejecting characteristics. Thus, an ink jet printer of a related art that has a heating portion for heating ink at somewhere of an ink feeding passage is disclosed in JP-A-2007-130907.

There is, however, a problem with a printer using the above related art. That is, when an excessive amount of ink is sucked in a suction treatment for cleaning of a head, the ink that has not been sufficiently heated at the heating portion flows into the head, so that favorable ink ejecting characteristics are not obtained.

SUMMARY

An advantage of some aspects of the invention is to provide a liquid ejecting apparatus that is able to stabilize the temperature of ink to be fed to a head, and a maintenance method thereof.

A liquid ejecting apparatus according to an aspect of the invention includes: a heating portion for heating liquid; a liquid ejecting head for ejecting the liquid heated by the heating portion; and a maintenance device for performing maintenance of the liquid ejecting head by causing the liquid to be discharged from the liquid ejecting head through sucking operation, where the maintenance device performs a first suction for cleaning the liquid ejecting head by causing the head to discharge the liquid and then the heating portion heats the liquid for a specific period of time before the liquid is fed to the liquid ejecting head after the first suction is performed. Furthermore, the liquid ejecting apparatus may further include a flow passage, which is heated by the heating portion, for feeding the liquid to the liquid ejecting head, where the heating portion heats the liquid in the flow passage for the specific period of time before the liquid is fed to the liquid ejecting head after the first suction is performed. Furthermore, in the liquid ejecting apparatus, it is preferable that the maintenance device stop suctioning until the liquid is heated by the heating portion, that is, after the specific period of time has passed, the maintenance device performs a second suction with a suction force weaker than that of the first suction.

In the liquid ejecting apparatus according to an aspect of the invention, although the liquid near the heating portion is not yet heated just after the cleaning by the first suction, heated liquid may be fed to the liquid ejecting head even after the first suction, by waiting until the liquid is heated by the heating portion. Since a liquid, which has been heated to a predetermined temperature by the heating portion, is fed by the second suction whose suction force is weaker than that of the first suction, a feeding operation during heating becomes possible. Therefore, the temperature of the liquid to be fed to the liquid ejecting head after the cleaning is stabilized and favorable ejecting characteristics are able to be obtained.

In the above liquid ejecting apparatus, it is preferable that the maintenance device perform the second suction to flow the liquid at a flow rate lower than that of the liquid ejected from the liquid ejecting head. According to this configuration, since the second suction is performed at a flow rate lower than that of liquid ejected from the liquid ejecting head, it is possible to reliably feed the liquid having been heated to a predetermined temperature into the liquid ejecting head.

In the above liquid ejecting apparatus, it is preferable that the liquid ejecting head perform recording operation by ejecting the liquid to a recording media after completion of maintenance by the maintenance device. According to this configuration, since the liquid having a predetermined temperature has been fed into the liquid ejecting head, it is possible to continuously perform a recording operation with high ink ejection accuracy after completion of the maintenance.

In the above liquid ejecting apparatus, a temperature detector for detecting the temperature of the liquid is further included, and it is preferable that the maintenance device determine the specific period of time (waiting time) following the first suction on the basis of detection results of the temperature detector. According to this configuration, since the specific period of time following the first suction is determined on the basis of the liquid temperature, it is possible to reduce the waiting time as much as possible. The time required for the maintenance operation may therefore be reduced.

In the above liquid ejecting apparatus, a plurality of flow passages for feeding the liquid to the liquid ejecting head is further included, and it is preferable that the heating portion be provided with a first heat source being in one body that heats the plurality of flow passages, and a second heat source that heats the plurality of flow passages from the first heat source to the liquid ejecting head.

According to this configuration, the liquid fed to the liquid ejecting head is heated by the first heat source located away from nozzles and is kept warm by the second heat source located close to the nozzles. Therefore, temperature control of the liquid is properly performed to feed the liquid with constant temperature to the liquid ejecting head. Accordingly, due to the stabilized liquid temperature, the liquid ejecting head is able to obtain favorable liquid ejecting characteristics. In addition, since the first heat source is a single component that warms the plurality of flow passages at once, it is not necessary to provide a warming device to each of the flow passages. Thus, the apparatus may be prevented from increasing in size.

In the above liquid ejecting apparatus, it is preferable that the second heat source be provided with a heater and a fan that blows air warmed by the heater toward the plurality of flow passages. According to this configuration, since warm air is sent toward the plurality of flow passages evenly by the fan, temperature control of the liquid to be fed to the liquid ejecting head may properly be performed. While warming is difficult to be done on the side close to the nozzles, by sending warm air generated by the heater using the fan, it becomes possible to warm flow passages without increasing of the head in size. Although the efficiency in heat transfer using the fan is not so high, the second heat source can keep the temperature of the liquid that has been heated up to the temperature by the first heat source. Therefore, the head is not increased in size while the liquid is not decreased in temperature.

In the above liquid ejecting apparatus, it is preferable that the plurality of flow passages warmed by the first heat source be formed in a channel plate that includes a plate member that has a plurality of grooves and a sealing member that is tightly laminated on a face of the plate member where the grooves are provided. According to this configuration, the plurality of grooves is realized by a simple structure using the plate member provided with the grooves and the sealing member. Furthermore, in the liquid ejecting apparatus, it is also preferable that the plate member and the sealing member each be a single component. According to this configuration, the number of components is able to be reduced, and the efficiency in heat transfer to the plate member is able to be increased.

In the above liquid ejecting apparatus, it is preferable that the first heat source be a heater disposed on the plate member. According to this configuration, since the heater directly heats the plate member, it is possible to simply and reliably heat the liquid in the flow passages made of the plurality of grooves.

In the above liquid ejecting apparatus, it is preferable that each of the plurality of flow passages warmed by the second heat source include a liquid storing portion, which temporarily stores the liquid to be fed to the liquid ejecting head. According to this configuration, since the liquid storing portion whose temperature is easily reduced is warmed by the second heat source, it becomes possible to highly stabilize the characteristics of the liquid to be fed to the liquid ejecting head. Furthermore, in the above liquid ejecting apparatus, it is also preferable that air from the fan pass through between the plurality of liquid storing portions. According to this configuration, since the liquid storing portions have wide width compared with those of the other flow passages, from the reason of storing the liquid, the area exposed to warm air becomes large when air from the fan passes through between the liquid storing portions. Thus, effective heat transfer is achieved.

According to an aspect of the invention, a maintenance method of a liquid ejecting apparatus, which has a heating portion for heating liquid and a liquid ejecting head for ejecting the liquid heated by the heating portion, includes a maintenance process for performing maintenance of the liquid ejecting head by causing the liquid to be discharged from the liquid ejecting head. The maintenance process includes performing a first suction that causes the liquid to be discharged from the liquid ejecting head, waiting until the liquid is heated for a specific period of time by the heating portion after the first suction, and performing a second suction that is performed with a suction force weaker than that of the first suction after the waiting period.

In the maintenance method according to the aspect of the invention, after cleaning of the liquid ejecting head by the first suction, the liquid ejecting head can receive heated liquid by the second suction, which has been heated by the heating portion to a predetermined temperature during waiting time (the above specific period of time). Accordingly, since the temperature of the liquid fed to the liquid ejecting head is stabilized, favorable ejecting characteristics are obtained even after the maintenance operation.

In the above maintenance method, it is preferable that the second suction be performed by sucking at a flow rate lower than that of the liquid ejected from the liquid ejecting head. According to this configuration, since the second suction is performed at a flow rate lower than that of the liquid ejected from the liquid ejecting head, it is possible to reliably feed the liquid having been heated to a predetermined temperature into the liquid ejecting head.

In the above maintenance method, it is also preferable that the temperature of the liquid be detected and the specific period of time (waiting time) for the waiting is determined on the basis of the detection results. According to this configuration, since the specific waiting time is determined on the basis of the liquid temperature, it is possible to reduce the waiting time as much as possible. The time required for the maintenance is therefore able to be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
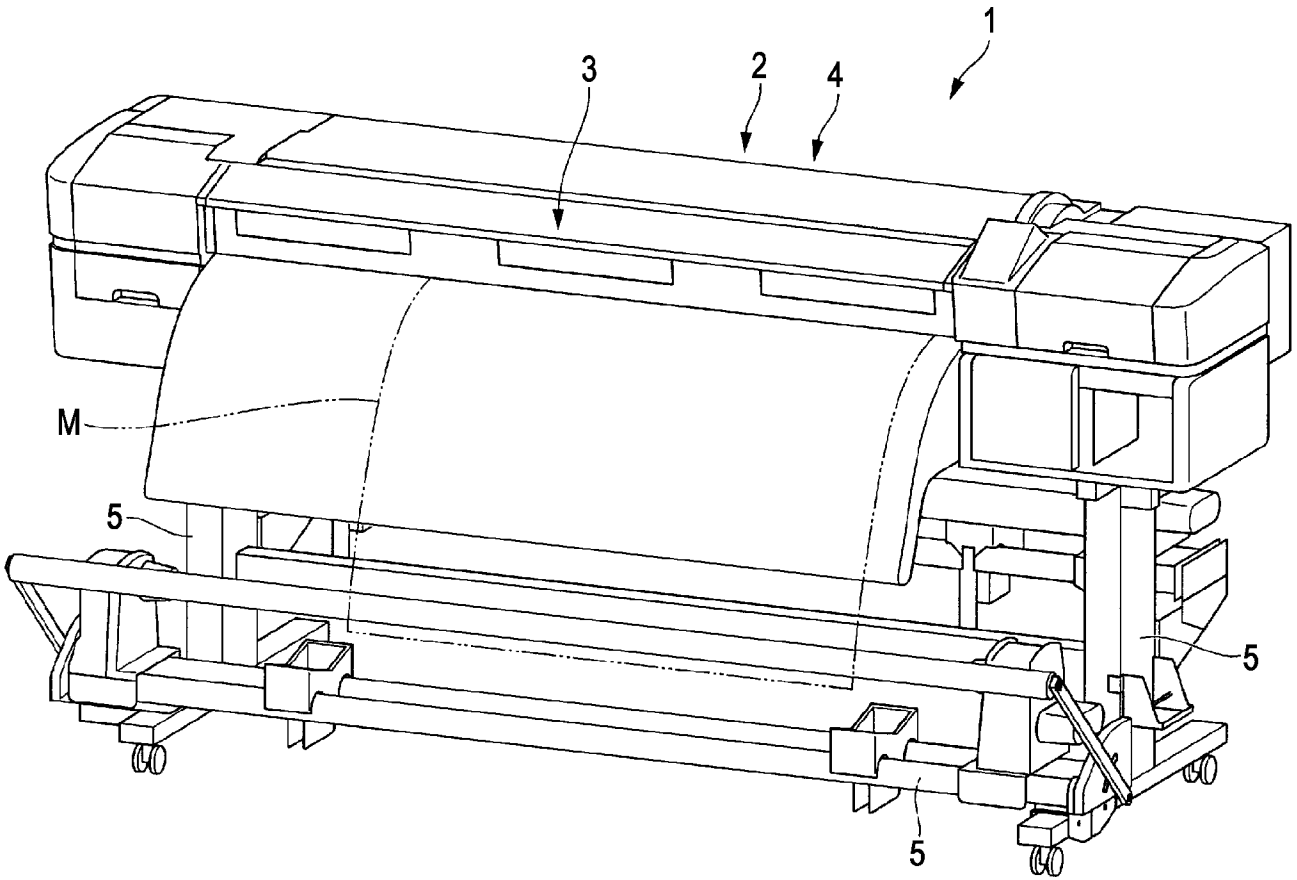
FIG. 1 is a perspective view illustrating a printer according to an embodiment of the invention.

An embodiment of a recording apparatus according to the invention will be described below with reference to the attached drawings. It is noted that, in the drawings used for the following description, respective members are each illustrated by being appropriately scaled so as to be recognizable. In this embodiment, an ink jet printer (hereinafter, simply called as "printer 1") is exemplified as a liquid ejecting apparatus according to the invention.

Figure 2:
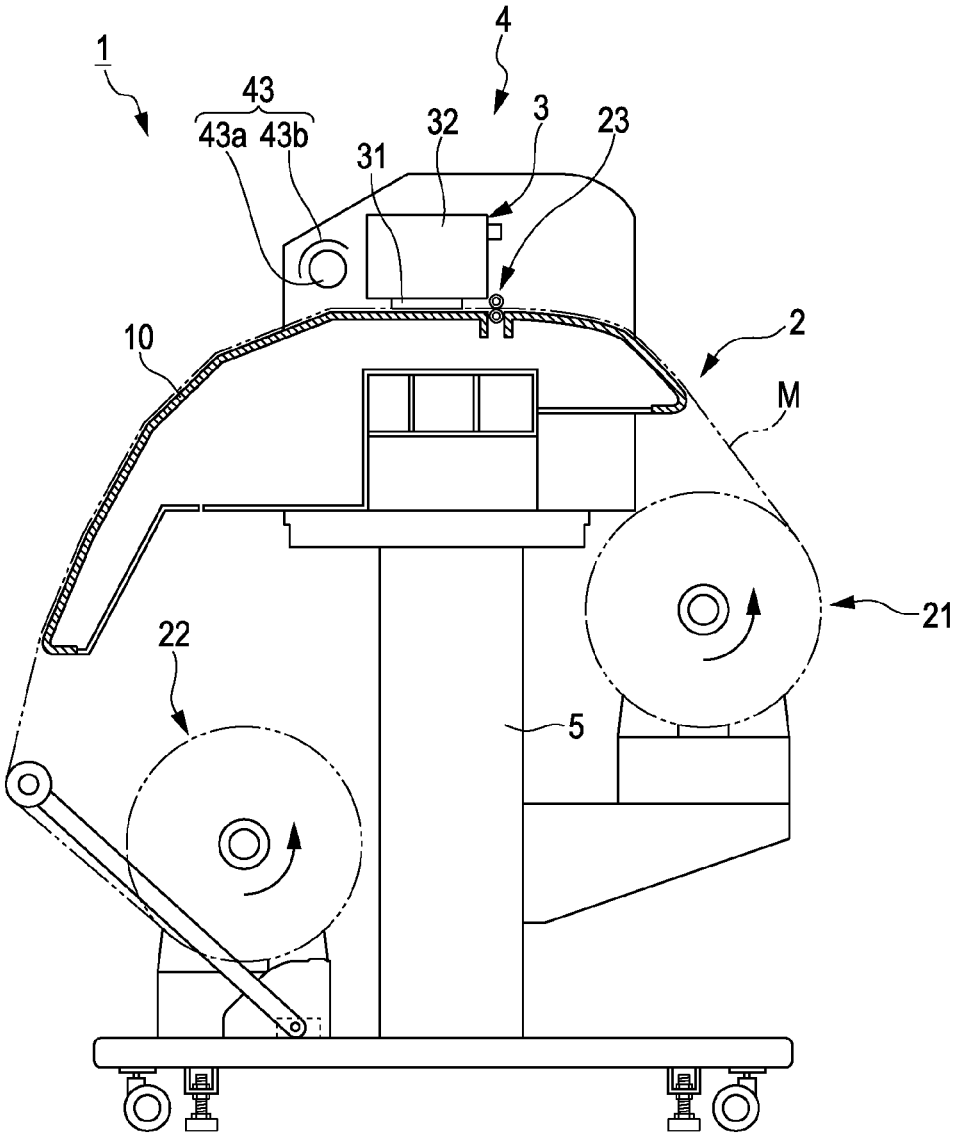
FIG. 2 is a cross-sectional view illustrating a general configuration of the printer.

FIG. 1 is a perspective view illustrating an external appearance of the printer 1, and FIG. 2 is a cross-sectional view illustrating the general configuration of the printer 1.

The printer (recording apparatus) 1 is a large format printer (LFP), which performs printing on a relatively large media M. The media M is a rolled media having a width of, for example, about 64 inches and made of vinyl chloride film, paper, or the like.

The printer 1 includes a transport unit 2 for transporting the media M by a roll-to-roll method; a recording unit 3 for recording images, characters, and the like by ejecting liquid ink (for example, ultraviolet curable ink) to the media M; and a treatment unit 4 for curing the ink, which has been ejected onto the media M, by applying ultraviolet rays. These units are supported by a body frame 5.

The transport unit 2 includes a supply reel 21 transporting the media M wound in a roll form; a take-up reel 22 winding the transported media M into a roll form; and a pair of transport rollers 23 for transporting the media M while pinching the media M moving along the transport path from the supply reel 21 to the take-up reel 22. The supply reel 21 and the take-up reel 22 and the pair of transport rollers 23 are driven by a motor and reduction gears (not illustrated).

The recording unit 3 includes an ink jet head 31, which is located on the downstream side of the pair of transport rollers 23 and ejects ink to the media M on the transport path, and a carriage 32, which has the ink jet head 31 mounted thereon and freely reciprocates in the media-width direction. The ink jet head 31 is provided with a plurality of nozzles Nz (refer to FIG. 3) and configured to eject ultraviolet curable inks, which are selected based on the material of the media M. The ink jet head 31 may eject plural color inks (five colors in this embodiment) and have rows of nozzles (five rows in this embodiment) for ejecting respective color inks.

Main chemical components of the ultraviolet curable ink are a resin, a photopolymerization initiator serving as a curing agent, and a solvent or a dispersion medium. It is possible to form functional liquid having a specific function by adding to the main chemical components a coloring agent such as a pigment or a dye and a high-performance material such as a hydrophilic or liquid-repellent surface reforming material. In this embodiment, pigments of cyan, magenta, yellow, and black are added to the main components. The resin material of ink, which forms a resin coat, is not particularly limited as long as being liquid at room temperature and being a material that becomes a polymer by polymerizing. It is preferable to be a resin having a low viscosity and to be in a form of oligomer. It is further preferable to be a form of monomer. As the photopolymerization initiator, which is an additive for progressing cross-linking reaction through acting on the cross-linkable bases of the polymer, benzyl dimethyl ketal or the like is able to be used. The solvent or the dispersion medium controls the viscosity of the resin.

A media support 10 is a portion of the transport path from the supply reel 21 to the take-up reel 22, and is configured to support the media M thereon in a state of being upwardly curved.

The treatment unit 4 includes an ultraviolet irradiation assembly 43 that is located on the downstream side of the recording unit 3 for emitting ultraviolet rays toward the media M. The ultraviolet irradiation assembly 43 includes a light-emitting device 43*a* for emitting ultraviolet rays and a reflection plate 43*b*.

The light-emitting device 43*a* has a plurality of light emitting diodes (LED) installed in an array. These LEDs each emit light in the ultraviolet region by being supplied electric power. The reflection plate 43*b* condenses the ultraviolet rays by reflecting the rays emitted from the light-emitting device 43*a* and applies the condensed ultraviolet rays toward a recording surface of the media M.

The printer 1 according to this embodiment is one for ejecting highly viscous ultraviolet curable ink. For ejecting highly viscous ink like this embodiment from the ink jet head 31, it is necessary to decrease the viscosity of the ink by warming. Warming of the ink means to raise the ink temperature up to a certain temperature.

In this embodiment, accurate ejection from the ink jet head 31 is achieved through stabilization of the viscosity of the ink, which is to be fed to the ink jet head 31, by warming the ink to a predetermined temperature. Specifically, in this embodiment, the ink is warmed to, for example, a temperature of 35° C. and is intended to be ejected from the ink jet head 31 while the ink temperature is higher than 30° C.

Figure 3:
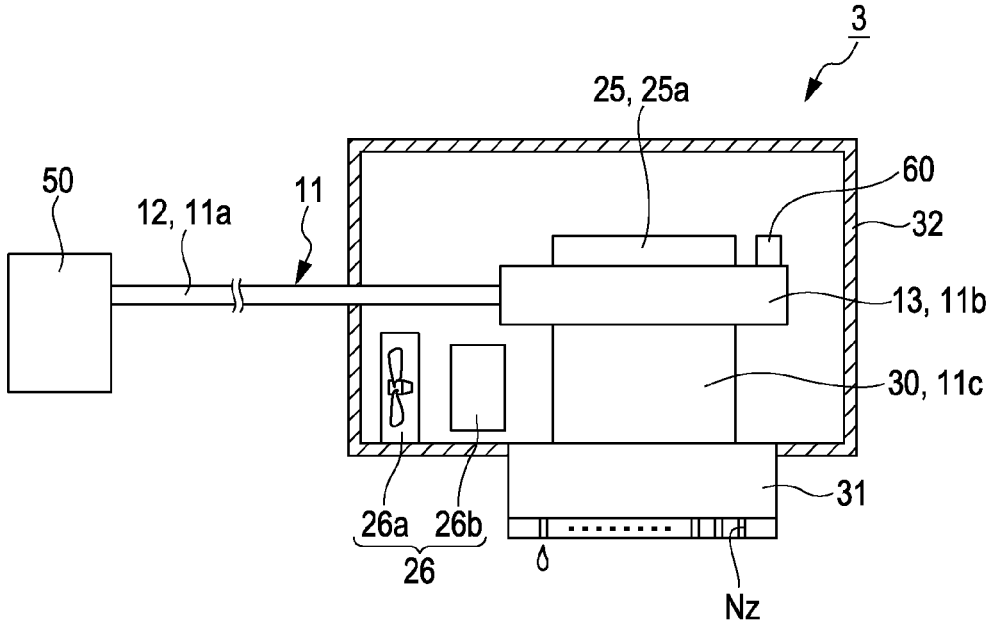
FIG. 3 is a schematic diagram illustrating an ink feeding system of the printer.

FIG. 3 is a schematic diagram illustrating an ink feeding system of the printer 1 according to this embodiment. As is understood from FIG. 3, the ultraviolet curable inks stored in ink cartridges 50 are fed to the ink jet head 31 mounted on the carriage 32, which is included in a recording unit 3, through a plurality of ink flow passages 11 (five passages in this embodiment). The plurality of ink cartridges 50, five cartridges in this embodiment, may be provided according to the colors of inks to be discharged from the ink jet head 31.

The ink flow passages 11 include first flow passages 11*a*, second flow passages 11*b* and third flow passages 11*c*. The first flow passages 11*a* have a plurality of flexible tubes 12 whose upstream ends are associated with respective ink cartridges 50. The second flow passages 11*b* are warmed by a first heat source (heating portion) 25.

Since the viscosity of the ultraviolet curable ink, which is fed from the ink cartridges 50 to the ink jet head 31, is subjected to changes in temperature as described above, it is important for the ultraviolet curable ink to control temperature. However, the temperature of the ultraviolet curable inks unintentionally decreases during temporal storage, which is caused by structural reasons, in pressure regulating portions 30. As a result, the viscosity of the inks may increase and the inks might not be properly discharged from the nozzles Nz, that is, a discharge failure occurs.

In contrast, in this embodiment, a second heat source 26 is provided that is able to warm the inks in the pressure regulating portions 30 having the third flow passages 11*c* formed between the first heat source 25 and the ink jet head 31. The inks that are temporarily stored in the pressure regulating portions 30 are thereby able to be warmed. The inks fed from the pressure regulating portions 30 to the ink jet head 31 may keep their viscosity in a desired level. Therefore, the inks may flow the passages in the pressure regulating portions 30 without clogging and properly fed to the ink jet head 31.

The second heat source 26 includes a heater 26*b* and a fan 26*a* that feeds the air having been warmed by the heater 26*b* to the side of the pressure regulating portions (third flow passages 11*c*). The second heat source 26 warms ambient air using the heater 26*b* and feeds the warmed air forward the pressure regulating portions 30 using the fan 26*a*. It thereby becomes possible to effectively warm the inks in the pressure regulating portions 30 up to a predetermined temperature (35° C. in this embodiment).

In the printer 1, the first heat source 25 and second heat source 26 are provided in the carriage 32 in a state of being hermetically sealed. The heat generated by the first heat source 25 and second heat source 26 is thereby to be effectively transferred to the ink flow passages 11 (second flow passages 11*b* and third flow passages 11*c*). Incidentally, the warm air may be circulated in the carriage 32 to enhance the efficiency of warming of the inks in passages 11.

The second flow passages 11*b* are formed in a channel plate 13, which warms flowing inks therethrough by the first heat source 25. The third flow passages 11*c* are formed in the pressure regulating portions 30 provided between the channel plate 13 and the ink jet head 31. On the channel plate 13, a temperature sensor (temperature detector) 60 is provided that detects the temperature of the inks in the second flow passages 11*b*. This temperature sensor 60 is arranged to send detection results to a maintenance device 55 described later.

The pressure regulating portions 30 are formed using resin such as polypropylene or the like, and each include an ink chamber, the volume of which varies depending on external pressure urging partitions of the ink chambers made of elastic sheets. This elastic sheet is deformable in the directions of expanding and contracting the ink chamber. Moreover, pressure variance of the ink is absorbed by the damper function due to the deformation of the elastic sheet. That is, the pressure regulating portions 30 each function as a pressure damper due to the action of the elastic sheet. The ink therefore is to be fed to the ink jet head 31 under the state in which the pressure variance has been absorbed in the pressure regulating portions 30. That is, each of the pressure regulating portions 30 is wide compared with the other flow passages 11*a* and 11*b*, and constitute liquid storing portions, which are able to temporarily store the ink to be fed to the ink jet head 31.

Figure 4A:
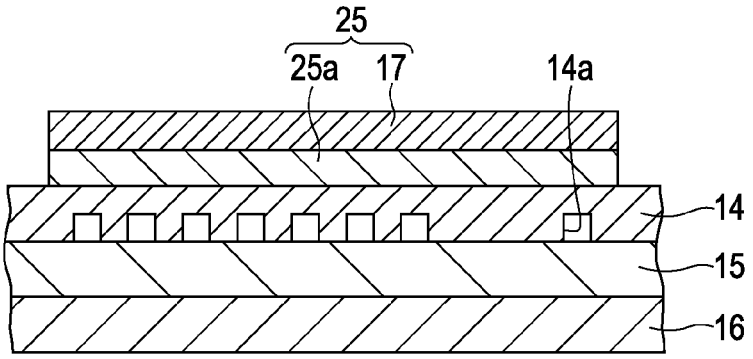
FIG. 4A is a cross-sectional view illustrating second flow passages and a first heat source.
Figure 4B:
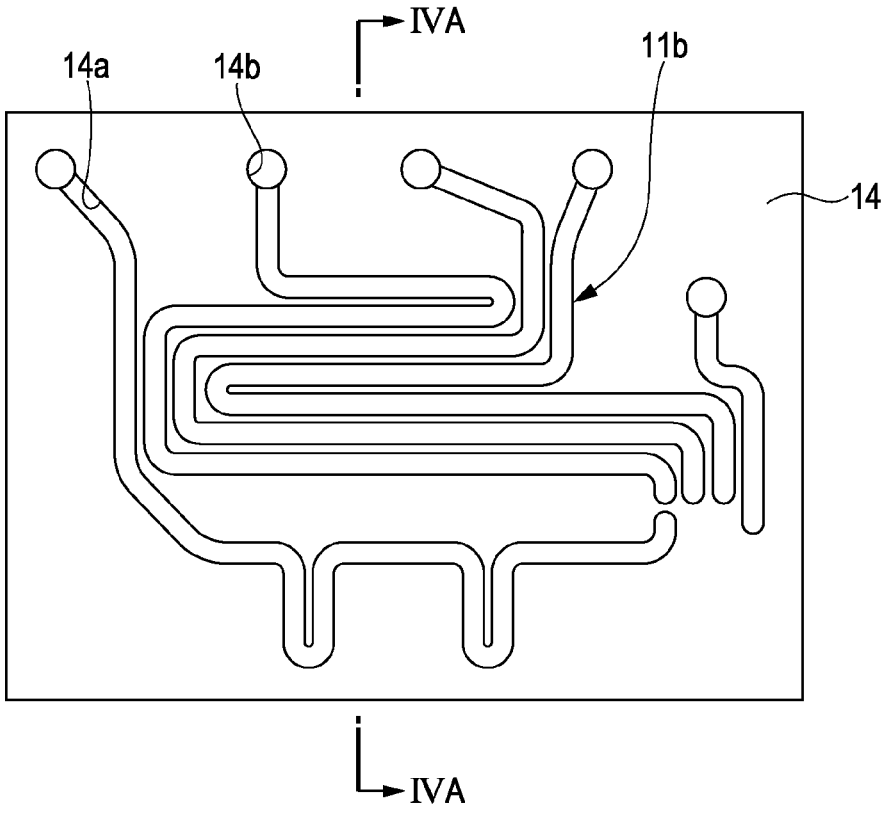
FIG. 4B is a plan view illustrating the second flow passages.

FIGS. 4A and 4B are drawings illustrating the configuration of the second flow passages 11*b* and the first heat source 25. FIG. 4A is a cross-sectional view taken along line IVA-IVA in FIG. 4B illustrating the configuration around the second flow passages 11*b*, and FIG. 4B is a plain view illustrating the configuration of a metal plate forming channels of the channel plate 13.

The channel plate 13 has a plurality of grooves (five grooves in this embodiment) 14*a* formed in a metal plate 14 illustrated in FIG. 4A. It is preferable that the metal plate 14 have a high thermal conductivity. In this embodiment, stainless steel is used for the metal plate 14. The grooves 14*a* formed in the metal plate 14 are associated with the plurality of tubes 12, which are the first flow passages 11*a*, through connection portions 14*b* provided at each upstream end thereof. Likewise, the other ends of the grooves 14*a* are associated with the plurality of pressure regulating portions (five grooves in this embodiment) 30 having the third flow passages 11*c*, in a not illustrated region in the drawing.

As illustrated in FIG. 4A, the channel plate 13 includes the metal plate 14 in which the plurality of grooves 14*a* are formed, a sealing plate (sealing member) 15 for sealing a surface of the metal plate on which the grooves 14*a* are formed, and a fixing plate 16 attached to the sealing plate 15 on the other surface with respect to the metal plate 14. The metal plate 14 and the fixing plate 16 holding the sealing plate therebetween are fixed together using screws at a not illustrated region in the drawing. The grooves 14*a* are sealed by the sealing plate 15. That is, the second flow passages 11*b* are constituted of the sealing plate 15 and the grooves 14*a*.

The first heat source 25 includes a heater 25*a* that is adhered to the channel plate 13. The heater 25*a* is constituted of, for example, a film member in which a resistance heating wire is embedded. Specifically, the heater 25*a* is directly stuck on the metal plate 14. On a face of the heater 25*a* opposite to the metal plate 14, a heat insulation material 17 is stuck, by which the heat of the heater 25*a* is to be effectively transferred to the side of the metal plate 14.

Since the second flow passages 11*b*, or the grooves 14*a*, are formed in the metal plate 14 and the metal plate 14 is directly heated by the heater 25*a* as described above, the inks in the second flow passages 11*b* (grooves 14*a*) are able to be effectively heated. It is therefore possible to effectively heat the plurality of ink flow passages 11 including the second flow passages 11*b*, which are the plurality of grooves 14*a*, with a single heat source (first heat source 25).

In the printer 1 according to this embodiment, maintenance treatment is performed to maintain the ink ejecting characteristics of the ink jet head 31. Specifically, the printer 1 includes the maintenance device 55 illustrated in FIG. 5.

The maintenance device 55 includes a cap member 56, which is able to come into contact with a nozzle face Nz1 provided with the nozzles Nz of the ink jet head 31; a suction pump 57, which is able to evacuate air from the space formed between the cap member 56 and the nozzle face Nz1; and a tube 58 for associating the cap member 56 with the suction pump 57.

The cap member 56 is formed in box-shape and the member encloses a region where the nozzles are formed on the nozzle face Nz1. At lease the tip 56*a* of the cap member 56 which comes into contact with the nozzle face Nz1 is made of an elastic material such as rubber. The tip 56*a* may thereby realize favorable sealing between the cap member 56 and the nozzle face Nz1. The cap member 56 is allowed to move up and down with respect to the nozzle face Nz1 by means of a drive mechanism (not illustrated). The cap member 56 is thereby rendered to rise up to the position at which it is enabled to come into contact with the nozzle face Nz1 at the time of maintenance, and to be placed at a waiting position below the maintenance position at any time other than maintenance.

The suction pump 57 is, for example, a tube pump, and the tube 58 is made of a resin having flexibility. By providing the tube 58 having flexibility like this, the aforementioned up-and-down movement of the cap member 56 might not be interfered.

Based on the configuration described above, the maintenance device 55 is able to reduce pressure in the space between the cap member 56 and the nozzle face Nz1 by driving the suction pump 57 in a state where the cap member 56 comes into contact with the nozzle face Nz1. By performing such a suction treatment, the maintenance device 55 may cause the ink to be forcedly discharged from the nozzles Nz.

The maintenance treatment of, for example, discharging excessively viscous ink and expelling air bubbles from the inside of the ink jet head 31 is thereby performed, and the printer 1 is able to recover the ink ejecting characteristics of the nozzles Nz.

Figure 5:
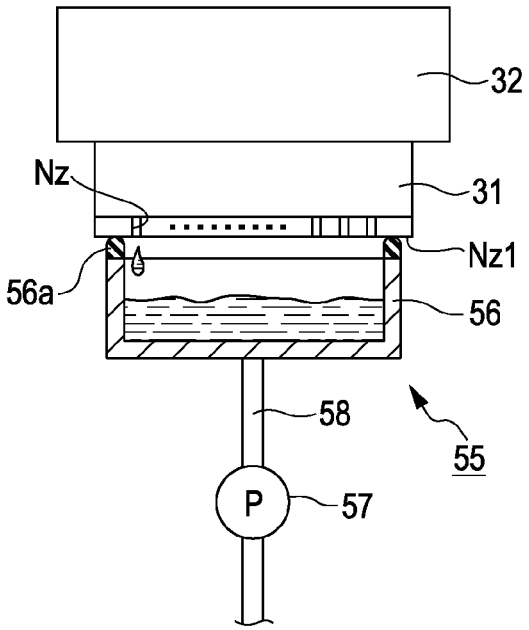
FIG. 5 is a schematic diagram illustrating a general configuration of a maintenance device.

Besides the above maintenance device 55, the printer 1 is provided with a wiper (cleaning member) for wiping the nozzle face Nz1 as a component for maintenance (not illustrated in FIG. 5). The wiper serves for wiping the ink adhered on the nozzle face Nz1 due to the suction treatment, which is conducted with the maintenance device 55 or a preliminary ink ejection treatment (flushing treatment), which is implemented for arranging the meniscus in the nozzles Nz.

The flow rate of the ink forcedly discharged from the nozzles Nz when sucked by the maintenance device 55 is about 0.2 to 0.3 g/s, and the flow rate of the ink ejected from the nozzles Nz at the time of recording operation is about 0.1 g/s.

The flow rate of the ink at the time of sucking operation using the maintenance device 55 is high compared with the flow rate of the ink at the time of ejecting operation. Accordingly, the inks discharged from the nozzles Nz might not have been sufficiently warmed by the first heat source 25 and second heat source 26 during flowing to the ink jet head 31 from the ink flow passages 11. That is, the ink stored in the ink jet head 31 after having been sucked by the maintenance device 55 is in a state not sufficiently warmed by the first heat source 25 and second heat source 26. Since the printer 1 does not have any unit for heating the inks in the ink jet head 31, the inks are not warmed sufficiently and the viscosity thereof become higher than the specified value, which may increase the probability of failing in favorable ejecting.

Figure 6:
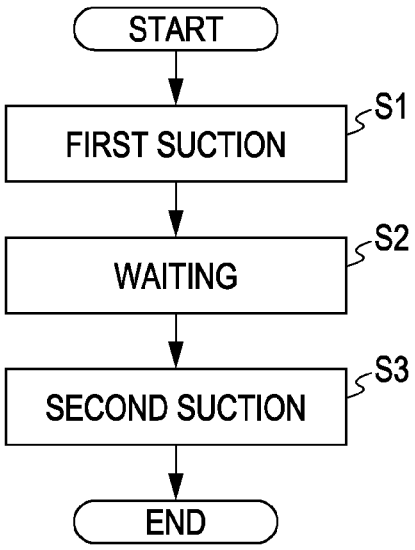
FIG. 6 is a flowchart illustrating a maintenance process of the printer.

In order to solve such a problem, a maintenance process conducted by the maintenance device 55 of the printer 1 according to this embodiment has steps illustrated in a flow chart of FIG. 6. Specifically, the maintenance process performed in the printer 1 includes a suction step (first suction step) S1 for causing ink to be discharged from the ink jet head 31 by a sucking operation; a waiting step S2 for waiting until inks are heated by the first heat source 25 and second heat source 26 after the first suction step S1; and a loading step (second suction step) S3 for loading inks into the head with a suction force weaker than that of the first suction step S1 after the waiting step S2.

Figure 7:
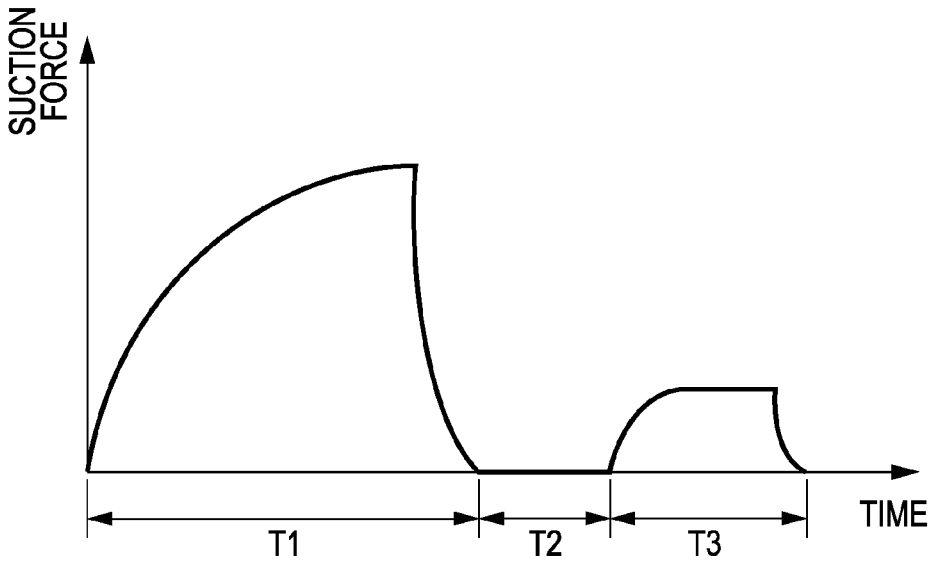
FIG. 7 is a graph illustrating a suction force variation during a maintenance process.

FIG. 7 is a graph illustrating the variation of the suction force (pressure) of the suction pump 57 in the maintenance device 55 with respect to the time during the maintenance process. The maintenance device 55 performs the sucking operation for causing ink to be discharged from the nozzles Nz by driving the suction pump 57 under the state in which the cap member 56 is in contact with the nozzle face Nz1. At that time, the maintenance device 55 drives the suction pump 57 for the time T1 as illustrated in FIG. 7. Incidentally, the suction force of the suction pump 57 at the first suction step S1 is set so that the flow rate of the ink discharged from the nozzles Nz becomes about 0.2 to 0.3 g/s as described above.

Since the flow rate of the ink in the head 31 is unintentionally high at the first suction step S1, the ink in the head is not sufficiently warmed when the first suction step S1 is completed.

For this reason, the maintenance device 55 implements the waiting step S2. At the waiting step S2, the maintenance device 55 halts to drive the suction pump 57 for the period of time T2. During the time T2, the inks in the ink flow passages 11 are heated by the first heat source 25 and second heat source 26 up to a predetermined temperature. The time T2 at the waiting step S2 varies depending on various conditions such as the ambient temperature around the printer 1, the temperature of the inks, and the like. Specifically, in this embodiment, the maintenance device 55 changes the waiting time T2 on the basis of the temperature of the ink in the second flow passages 11*b* detected by the temperature sensor 60. It thereby becomes possible to reduce the waiting time as much as possible and to reduce the time required for maintenance.

After the waiting step S2, the maintenance device 55 performs the sucking operation for discharging ink from the nozzles Nz by driving the suction pump 57 with a suction force weaker than that of the first suction step S1 under the state in which the cap member 56 is in contact with the nozzle face Nz1 in the second suction step S3. At that time, the maintenance device 55 drives the suction pump 57 for the time T3 as illustrated in FIG. 7. Incidentally, the suction force of the suction pump 57 at the time of the second suction step S3 is set at a flow rate lower than a flow rate of 0.1 g/s at which rate, the inks are discharged from the nozzles Nz during recording operation described above. Since the sucking operation at the second suction step S3 is thereby performed at a flow rate lower than that at the time of ink ejection, it is possible to feed inks having been warmed to the predetermined temperature by the first heat source 25 and second heat source 26 to the ink jet head 31.

Upon input of a job command for printing start, the printer 1 described above operates as follows. First, based on the above job command, the first heat source 25 (heater 25*a*) and second heat source 26 (heater 26*a* and fan 26*b*) are activated to heat the inks in the ink flow passages 11 (second flow passages 11*b* and third flow passages 11*c*).

In this embodiment, since the upper stream side of the ink flow passages 11 is warmed by the first heat source 25 and the downstream side is warmed by the second heat source 26, that is, since warming process is conducted in two stages, it is possible to stabilize the temperature of the inks to be fed to the ink jet head 31.

When the temperature of the inks in the ink flow passages 11 is maintained at a predetermined level, the media M is transported to a printing area of the media support 10 and the ink jet head 31 of the recording unit 3 starts printing on the media M. The ink jet head 31 mounted on the carriage 32 performs printing while moving reciprocally in the media-width direction.

The light-emitting device 43*a* of the treatment unit 4 applies ultraviolet rays to the media M on which the inks have been ejected. Since the inks used in this embodiment are of an ultraviolet curable type and include a photopolymerization initiator to be activated by ultraviolet rays as described above, the surface is immediately solidified or cured. The inks are cured like this and are fixed to the media M. According to this embodiment as described above, since landed ink droplets are irradiated by ultraviolet rays immediately after landing on the media M, the smear of the ink droplets is suppressed. Therefore, a less-smeared, high-quality printing is able to be achieved.

The printer 1 performs the maintenance treatment to maintain the ink ejecting characteristics of the ink jet head 31. The maintenance treatment is performed once every predetermined period on a regular basis after, for example, initial loading of ink into the ink jet head 31.

The printer 1 performs the maintenance treatment using the maintenance device 55. The maintenance device 55 performs the first suction step S1, waiting step S2 and second suction step S3 described above. In the printer 1 according to this embodiment, it is possible to feed, at the second suction step S3, the inks having been warmed to the predetermined temperature by means of the first heat source 25 and second heat source 26 to the ink jet head 31 that has undergone cleaning at the first suction step S1. Accordingly, favorable ejecting characteristics are achieved because the temperature of the inks fed to the ink jet head 31 after the cleaning are stabilized. That is, since the inks, which have been warmed to the predetermined temperature, are to be fed to the ink jet head 31, the maintained printer 1 is able to continuously perform a recording operation with high ink ejection accuracy.

In the printer 1, since the inks to be fed to the ink jet head 31 are warmed through two stages by means of the first heat source 25 and second heat source 26, the control of ink temperature is appropriately done, which allows the ink having a stable temperature to be fed to the ink jet head 31.

Incidentally, the invention is not limited to the above embodiment and may be practiced in various other forms not departing from the spirit and scope of the invention. For example, in the above embodiment, although the maintenance device 55 determines the time T2 of the waiting step S2 only by the temperature sensor 60 provided on the channel plate 13, another temperature sensor 60 may be provided in the pressure regulating portions 30 and the time T2 may be comprehensively determined on the basis of the detection results of the both sensors. If it is put into practice, the time T2 may be obtained with high accuracy and maintenance may be effectively implemented.

Furthermore, although the printer 1 that has the pressure regulating portions 30 serving as the third flow passages 11*c*, which partially constitute the ink flow passages 11, is exemplified in the above embodiment, this disclosure may be adopted to a printer 1 provided with sub-tanks, buffers or the like instead of the pressure regulating portions 30 for temporarily storing ink to be ejected from an ink jet head 31.

Since the sub-tanks, buffers or the like are wide portions compared with the other ink flow passages, the temperature of inks is apt to decrease; then, the control of ink temperature may be favorably implemented by warming with a second heat source 26.

Although the case that the recording apparatus is a printer 1 is exemplified in the above embodiment, the case is not limited thereto. The invention may also be adopted to other apparatuses such as copiers, facsimiles, and the like.

This liquid ejecting apparatus may be a recording apparatus that ejects or discharges liquid other than ink. The invention may be employed to a variety of recording apparatuses each provided with, for example, a recording head discharging minute droplets. Incidentally, the term "droplets" means the state of liquid discharged from the above recording apparatus, and includes granular form, teardrop shape, and drops having a string-like tail. In addition, the term "liquid" called herein means material that a recording apparatus is able to eject. For example, it may be a substance in a liquid phase, including a liquid-like substance having high or low viscosity, and liquid in a fluidized state or liquid as a state of a substance such as sol, gel water, other inorganic solvent, organic solvent, solution, liquid-like resin, liquefied metal (molten metal). In addition thereto, such fluidic substance in which particles of a functional material constituted of solid matter such as pigment or metal particles are dissolved, dispersed or mixed in solvent is also included. A typical example of liquid is ink (ultraviolet curable ink) described in the above embodiment. As the media M, besides papers, plastic films such as polyvinyl chloride based films or the like, a functional paper which is thinly extended under heat, a board, a metal plate and the like are included. The media M is not limited to rolled media, but may be previously cut recording media.

The entire disclosure of Japanese Patent Application No.: 2011-287711, filed Dec. 28, 2011 and 2011-287712, filed Dec. 28, 2011 are expressly incorporated by reference herein.

What is claimed is:

1. A liquid ejecting apparatus comprising:

a liquid ejecting head for ejecting a liquid;

a heating portion for heating a flow path for feeding the liquid to the liquid ejecting head; and a maintenance device for performing maintenance of the liquid ejecting head by causing the liquid to be discharged from the liquid ejecting head through a nozzle of the liquid ejecting head by a discharge operation, wherein the maintenance device performs a movement of the liquid for cleaning the liquid ejecting head by causing the head to discharge the liquid and the heating portion heats the liquid for a specific period of time before the liquid is fed to the liquid ejecting head after the movement is performed.

2. The liquid ejecting apparatus according to claim 1, further comprising:

the flow path for feeding the liquid to the liquid ejecting head, the flow being heated by the heating portion.

3. The liquid ejecting apparatus according to claim 1, wherein the maintenance device stops the movement until the liquid is heated by the heating portion and then performs a second movement with a force weaker than the force of the movement.

4. The liquid ejecting apparatus according to claim 3, wherein the maintenance device performs the second movement to flow the liquid at a flow rate lower than the flow rate of the liquid ejected from the liquid ejecting head.

5. The liquid ejecting apparatus according to claim 1, wherein the liquid ejecting head performs recording operation of ejecting the liquid to recording media after completion of maintenance through the maintenance device.

6. The liquid ejecting apparatus according to claim 1, further comprising:

a temperature detector for detecting a temperature of the liquid, wherein the maintenance device determines the specific period of time following the movement on the basis of detection results of the temperature detector.

7. The liquid ejecting apparatus according to claim 1, further comprising:

a plurality of flow passages for feeding the liquid to the liquid ejecting head, wherein the heating portion is provided with:

a first heat source being a single component that warms the plurality of flow passages; and a second heat source that warms the plurality of flow passages from the first heat source to the liquid ejecting head.

8. The liquid ejecting apparatus according to claim 7, wherein the second heat source is provided with:

a heater; and a fan that blows air warmed by the heater toward the plurality of flow passages.

9. The liquid ejecting apparatus according to claim 8, wherein each of the plurality of flow passages warmed by the second heat source include a liquid storing portion, which temporarily stores the liquid to be fed to the liquid ejecting head.

10. The liquid ejecting apparatus according to claim 9, wherein air from the fan passes through between the plurality of liquid storing portions.

11. The liquid ejecting apparatus according to claim 7, wherein the plurality of flow passages warmed by the first heat source are formed in a channel plate that includes a plate member that has a plurality of grooves and a sealing member that is tightly laminated on a face of the plate member where the grooves are provided.

12. The liquid ejecting apparatus according to claim 11, wherein the plate member and the sealing member each are a single component.

13. The liquid ejecting apparatus according to claim 12, wherein the first heat source is a heater disposed on the plate member.

14. The liquid ejecting apparatus according to claim 1, wherein the maintenance device performs the movement to flow the liquid at a flow rate higher than the flow rate of the liquid ejected from the liquid ejecting head.

15. The liquid ejecting apparatus according to claim 1, wherein the movement is performed by a suction.

16. The liquid ejecting apparatus according to claim 1, wherein the heating portion is provided on a carriage.

17. A maintenance method of a liquid ejecting apparatus including a heating portion for heating liquid and a liquid ejecting head for ejecting the liquid heated by the heating portion, the maintenance method comprising:

a maintenance process for performing maintenance of the liquid ejecting head by causing the liquid to be discharged from the liquid ejecting head, wherein the maintenance process includes:

performing a first suction that causes the liquid to be discharged from the liquid ejecting head;

waiting until the liquid is heated for a specific period of time by the heating portion after the first suction is performed; and performing a second suction that is performed with a suction force weaker than the force of the first suction after the waiting period.

18. The maintenance method according to claim 17, wherein the second suction is performed by sucking at a flow rate lower than the flow rate of the liquid ejected from the liquid ejecting head.

19. The maintenance method according to claim 17, wherein, during the waiting time, temperature of the liquid is detected and the specific period of time is determined on the basis of the detection results.

* * * * *